US006782929B1

(12) United States Patent
Madrid

(10) Patent No.: US 6,782,929 B1
(45) Date of Patent: Aug. 31, 2004

(54) PROCESS FOR STRENGTHENING PLYWOOD

(76) Inventor: Jeffrey Madrid, 1500 Kashlan Rd., La Habra Heights, CA (US) 90631

( * ) Notice: Subject to any disclaimer, the term of this patent is extended or adjusted under 35 U.S.C. 154(b) by 0 days.

(21) Appl. No.: 10/264,563

(22) Filed: Oct. 3, 2002

Related U.S. Application Data

(63) Continuation-in-part of application No. 09/420,601, filed on Oct. 19, 1999, now Pat. No. 6,460,868.

(51) Int. Cl.[7] ..... B27D 1/04

(52) U.S. Cl. ..... 144/349; 144/352; 156/92; 156/182

(58) Field of Search ..... 144/344, 346, 144/349, 352; 156/39, 40, 91, 92, 182, 253, 293, 300; 428/44, 50

(56) References Cited

U.S. PATENT DOCUMENTS 2,499,959 A 3/1950 Kruse et al. ..... 144/256
4,084,996 A * 4/1978 Wheeler
4,233,752 A 11/1980 Kleinguenther
5,073,431 A * 12/1991 Martinuzzo ..... 428/102
5,723,221 A * 3/1998 Brooker et al. ..... 10/321
6,214,142 B1 * 4/2001 Saputo ..... 156/92
2003/0116261 A1 * 6/2003 O'Brien ..... 156/219

FOREIGN PATENT DOCUMENTS

JP 04366603 * 12/1992

* cited by examiner

*Primary Examiner*—Allen Ostrager
*Assistant Examiner*—Shelly Self
(74) *Attorney, Agent, or Firm*—Edgar W. Averill, Jr.

(57) ABSTRACT

A process for increasing the strength of plywood. The process includes pressing the piece of plywood between two hard faces which have parallel ridges contacting the two outer sides of the plywood to be strengthened. The plywood is subjected to pressure which permanently impresses a series of parallel grooves in the two outer faces of the piece of plywood. This strengthens the piece of plywood so that it takes more force to break it than the same piece of plywood without such parallel grooves.

10 Claims, 2 Drawing Sheets

PROCESS FOR STRENGTHENING PLYWOOD

CROSS REFERENCE TO RELATED APPLICATIONS

This application is a continuation in part of applicant's application Ser. No. 09/420,601 filed Oct. 19, 1999, entitled "Corrugated Skateboard Deck and Method of Corrugating Skateboard Decks," now U.S. Pat. No. 6,460,868.

BACKGROUND OF THE INVENTION

The field of the invention is plywood fabrication and the invention relates more particularly to a process for strengthening plywood.

Applicant's above-referenced patent shows a process for placing grooves in the outer surface of a skateboard to provide a skateboard which has a better "pop." It also facilitates better slides. The specification and drawings of this patent are incorporated by reference herein.

Various processes for treating fibrous materials are known. One such process is shown in U.S. Pat. No. 4,233,752 where wood and other fibrous materials are held within a hermetically sealed heat insulated chamber. Pressure is applied to the fibrous materials and a vacuum is drawn on the interior of the hermetically sealed chamber to remove steam generated in the center of the fibrous materials. Numerous patents teach the shaping and placing of a curve in a stack of plywood panels. One such patent is U.S. Pat. No. 2,499,959.

BRIEF SUMMARY OF THE INVENTION

It is an object of the present invention to process conventional plywood in a manner which increases its strength.

The present invention is for a process for increasing a load support weight before breakage of a piece of plywood. A plurality of plies are placed between an upper platen and a lower platen and the plies have an adhesive in between each of the plies. The upper ply and the lower ply are contacted with a hard face member having a plurality of spaced parallel pointed ridges parallel to the grain in the outer plies of the piece of plywood. The plurality of plies are subjected to sufficient pressure to cause the adhesive to bond the adjacent plies and to impress permanent parallel grooves in the outer surfaces of the piece of plywood thereby increasing their load support strength.

DESCRIPTION OF THE PREFERRED EMBODIMENTS

Sheets of 4'×8' plywood are commonly used in many trades, especially the building trades. In the building trades, such sheets are used to support roofing and flooring. Because of the strength required in such applications, a particular thickness and number of plies of such pieces of plywood are selected to provide the requisite strength. It is readily understood that if a piece of plywood can be strengthened, then a piece of plywood having less thickness or fewer plies could be used after it has been strengthened. This potentially reduces the weight of the pieces of plywood and the amount of wood required to fabricate such piece of plywood.

Applicant had discovered in his process shown in U.S. Pat. No. 6,460,868 (Ser. No. 09/420,601) that he could fabricate a skateboard with increased strength by impressing grooves in the outer surfaces of the skateboard platform. It has also been discovered that the strength of conventional plywood can be increased by impressing such parallel grooves in the outer plies of the piece of plywood.

Figure 1:
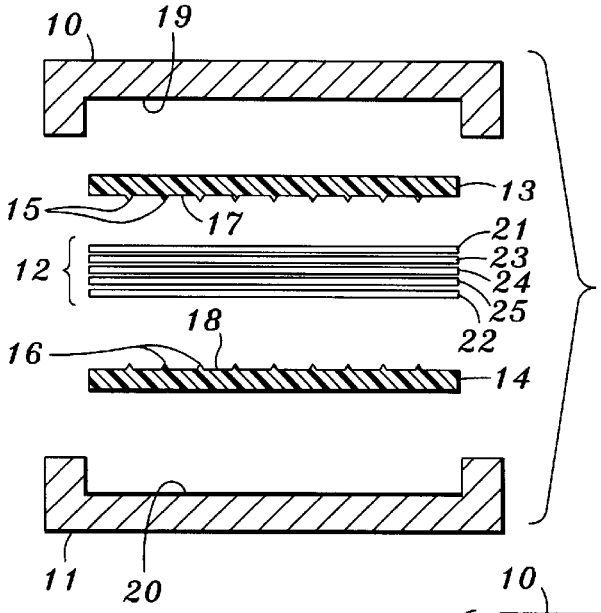
FIG. 1 is an exploded end view of a plurality of plies held between two platens and two hard faces.
Figure 4:
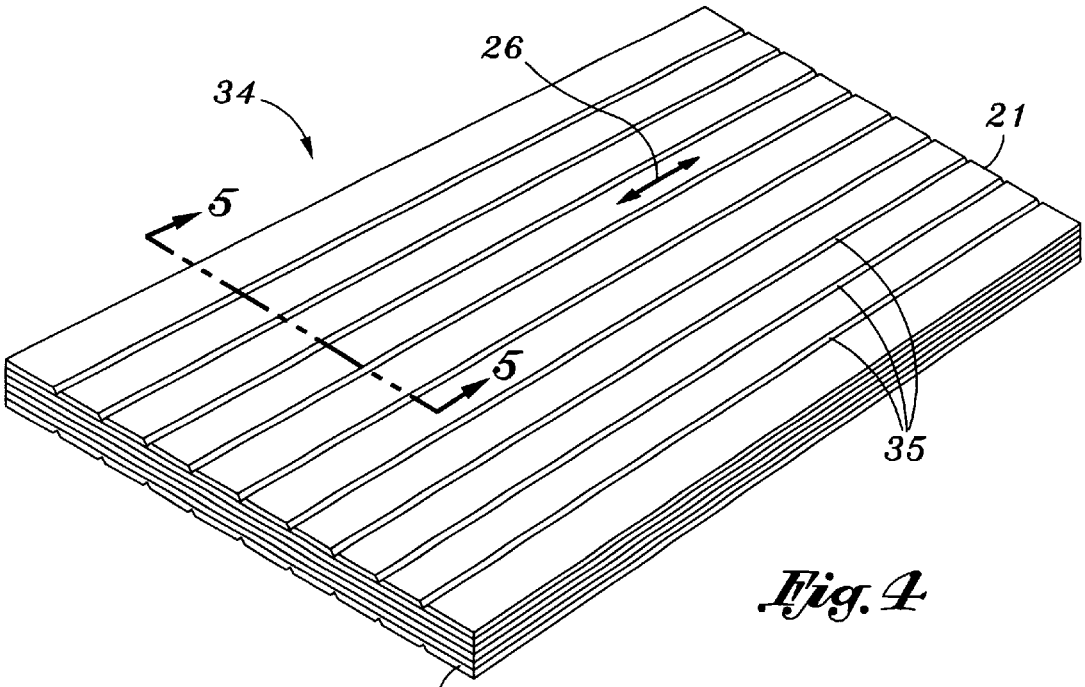
FIG. 4 is a perspective view of a piece of plywood made with the process of the present invention.

A process is diagrammatically shown in FIG. 1 of the drawings wherein an upper platen 10 and a lower platen 11 surround a plurality of plies 12. They also surround an upper hard faced member 13 and a lower hard faced member 14, each of which have a plurality of sharp ridges in otherwise generally planar surface 17 and 18, respectively. While the hard faced members 13 and 14 are shown as separate members from platens 10 and 11, it is, of course, understood that the inner faces 19 and 20 can be shaped to provide an identical hard face with sharp edges in place of the separate members 13 and 14. The plurality of wood plies have an upper ply 21 and a lower ply 22. Between the upper and lower plies are inner plies 23, 24, and 25. The grain direction of upper and lower plies 21 and 22 is shown in FIG. 4 and indicated by reference character 26. The inner plies have different grain directions, as well known to those skilled in the art of plywood fabrication.

Figure 2:
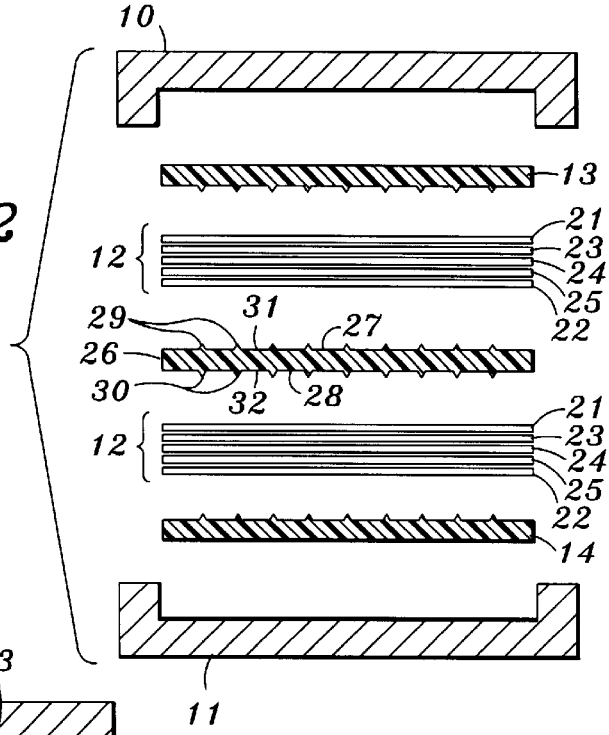
FIG. 2 is an exploded end view of two plurality of plies held between two platens and three members having hard faces with a plurality of ridges thereon.

As shown in FIG. 2, a plurality of pieces of plywood may be formed between platens 10 and 11 by using a double faced hard faced member 26. Member 26 has an upper face 27 and a lower face 28. These each have a series of parallel sharp ridges 29 and 30. These sharp ridges extend downwardly from generally planar surfaces 31 and 32. Of course, more than two sets of plies can be used by adding additional double faced hard faced members.

Layers of adhesive are placed between adjacent ply surfaces as indicated by reference character 33 in FIG. 2. It is to be understood that such adhesive is placed between all ply faces prior to the closing of the platen. Conventional plywood adhesive may be used.

Figure 3:
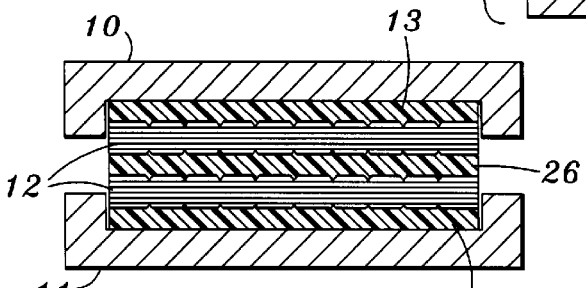
FIG. 3 is a view analogous to FIG. 2 with the platens in a closed configuration.

As shown in FIG. 3, platens 10 and 11 have been closed against the object shown in FIG. 2. The platens can exert a pressure between about 50 and 150 psi. The shape of ridges such as ridges 15, are referred to as "sharp," however this is not intended to mean sharp in the sense of a knife, but instead, indicates that the ridges form an angle of about between 45° and 90° at the point. Plywood thicknesses, such as one-quarter, one half, five-eighths, and three-fourths are contemplated in standard plywood PCA and adhesive would be used. This accomplishes the bonding of the layers of the plywood as well as the impressing of a plurality of parallel grooves in the upper and lower surfaces of the upper and lower plies 21 and 22. The plywood may be heated to speed the curing of the adhesive, but it is important that the platens 10 and 11 be located in the atmosphere rather than in a hermetically sealed chamber. This greatly reduces the cost and increases the production rate of the process of the present invention.

Figure 5:
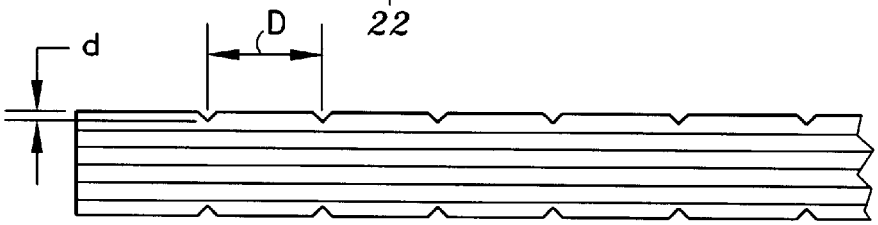
FIG. 5 is a cross-sectional view taken along line 5—5 of FIG. 4.

A 4' by 8' sheet of plywood is shown in FIG. 4 and indicated generally by reference character 34. Plywood sheet 34 has a plurality of grooves 35 formed in both the upper ply 21 and the lower ply 22. Grooves 35 are parallel to grain direction 26 on both the upper ply and the lower ply. The grain direction of the lower ply is the same as the grain direction on the upper ply. An enlarged cross-sectional view of plywood sheet 34 is shown in FIG. 5 where the depth of each groove is indicated by reference character "d". The distance between adjacent parallel grooves is indicated by reference character "D" in FIG. 5. The depth in "d" is preferably about 1/64 th of an inch and the distance between the parallel grooves "D" is preferably about ½ inch.

Figure 6:
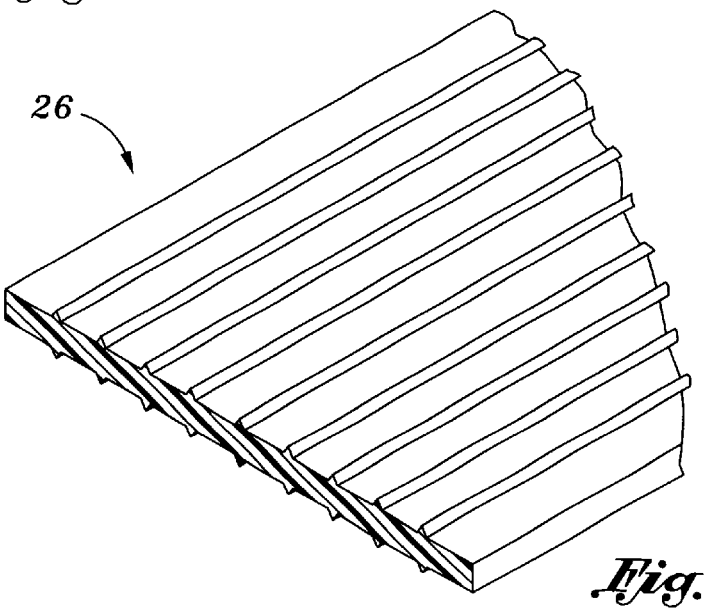
FIG. 6 is a perspective view of a portion of a piece of plastic which is placed between two sets of plies as shown in FIG. 2.

One example of a hard faced member 26 is shown in FIG. 6. It is preferably fabricated from a polymer such as high density polyethylene, although other materials, such as metal, may be used to provide longer life in commercial plywood treating operations. No heat inducing passages or members are needed within member 26 and it is preferred that none be used, however, in some production operations, heating may be provided to increase the speed of production.

Samples of pieces of plywood have been made. Such pieces have been subjected to testing and increased strength has been demonstrated. A three point loading method test using the procedure outlined in ASTM D 790-00 was used. The test procedure was carried out at a crosshead rate of 0.20 inch per minute on a MTS servo-hydraulic universal testing machine equipped with a three point loading test fixture. The loading nose was one inch in diameter and the support noses were 0.5 inch in diameter without using the loading pats. The span of support noses was set at 16 times the thickness of the sample. A PC based data acquisition system was used to monitor load and crosshead displacement until failure. Ultimate flexure strength was defined as three times the maximum observed load times the support span in inches divided by two times the width in inches times the nominal thickness in inches squared. The tests were carried out on 10" by 3" specimens. The results on an average of five tests on each sample are as follows:

| Specimen | Ultimate Flexural Strength (KSI) |
|---|---|
| Group B | 16.6 |
| Group B1 | 18.4 |
| Group C | 15.3 |
| Group C1 | 15.3 |
| Group D | 12.0 |
| Group D1 | 13.6 |

The lack of improvement of Group C is believed to be the result of the use of a seven ply plywood configuration and a hardwood veneer. It is believed that without the hardwood veneer, an increase in strength would have resulted.

Thus, it has been demonstrated that in most cases, the strength of a piece of plywood may be increased without the addition of any materials, such as additional plies or more plywood. This increase can permit the use of thinner pieces of plywood for such applications as flooring and roofing.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A process for increasing a load support weight before breakage of a piece of plywood, said piece of plywood having an upper ply and a lower ply having a grain in a first direction and a plurality of inner plies, said process comprising:

placing a plurality of plies between an upper platen having an upper platen hard face and a lower platen having a lower platen hard face, said plurality of plies having an adhesive in intersections between faces of adjacent plies;

contacting said upper ply with an upper platen hard face having a plurality of spaced, parallel pointed ridges parallel to said first direction;

contacting said lower ply with a lower platen hard face also having a plurality of spaced, parallel pointed ridges parallel to said first direction;

subjecting said plurality of plies to sufficient pressure to cause said adhesive to bond said adjacent plies at said intersections and to impress permanent parallel grooves in an outer surface of said upper ply and an outer surface of said lower ply thereby increasing said load support weight before breakage.

2. The process of claim 1 wherein said subjecting step is carried out with said platens being maintained at atmospheric pressure.

3. The process of claim 2 wherein said platens exert a pressure on said plurality of plies between 50 and 100 psi.

4. The process of claim 1 wherein said upper and lower platen hard faces have parallel ridges separated by about one-half inch.

5. The process of claim 4 wherein said pointed ridges of said upper and lower platen hard faces extend about one eighth of an inch from a generally planar surface of said upper and lower platen hard faces.

6. The process of claim 1 wherein at least a plurality of said upper and lower platen hard faces are fabricated from a polymer.

7. The process of claim 6 wherein said polymer is high density polyethylene.

8. The process of claim 1 wherein said plurality of plies are four feet by eight feet rectangular sheets.

9. The process of claim 8 wherein there are five plies between said upper ply and said lower ply.

10. A process for increasing a load support weight before breakage of a piece of plywood, said piece of plywood having an upper ply and a lower ply each having a grain in a first direction and a plurality of inner plies, said process comprising:

placing a plurality of plies between a generally planar upper platen and a generally planar lower platen, said plurality of plies having an adhesive in intersections between faces of adjacent plies;

contacting said upper ply with an upper platen hard face having a plurality of spaced, parallel pointed ridges parallel to said first direction and said parallel pointed ridges extending outwardly a distance of about one-eighth of an inch from a generally planar face and said ridges being separated a distance of about one-half of an inch;

contacting said lower ply with a lower platen hard face also having a plurality of spaced, parallel pointed ridges parallel to said first direction and said parallel pointed ridges extending outwardly a distance of about one-eighth of an inch from a generally planar face and said ridges being separated a distance of about one half of an inch;

subjecting said plurality of plies to sufficient pressure to cause said adhesive to bond said adjacent plies at said intersections and to impress permanent parallel grooves in an outer surface of said upper ply and an outer surface of said lower ply thereby increasing said load support weight before breakage.

* * * * *